US005775479A

United States Patent [19]

Carle

[11] Patent Number: 5,775,479

[45] Date of Patent: Jul. 7, 1998

[54] LEVER DEVICE FOR ACTUATING THE LIFTING MEMBER AND THE COUNTER-LIFTING MEMBER IN AUTOMATIC MACHINES FOR WRAPPING SWEETS, CHOCOLATES OR SIMILAR PRODUCTS

[75] Inventor: Marco Giovanni Carle, Milan, Italy

[73] Assignee: Carle & Montanari S.p.A., Bologna, Italy

[21] Appl. No.: 630,484

[22] Filed: Apr. 10, 1996

[30] Foreign Application Priority Data

Apr. 14, 1995 [IT] Italy ..... BO95A0166

[51] Int. Cl.[6] ..... B65G 47/90

[52] U.S. Cl. ..... 198/468.8; 198/468.2

[58] Field of Search ..... 198/483.1, 486.6, 198/486.8, 375, 378

[56] References Cited

U.S. PATENT DOCUMENTS 2,642,707 6/1953 Sandberg .

FOREIGN PATENT DOCUMENTS 0 374 137 6/1990 European Pat. Off. .
0073394 6/1960 France ..... 198/468.8
2 439 132 5/1980 France .
1136628 9/1962 Germany ..... 198/468.8
11 80 446 10/1987 Italy .
740283 11/1955 United Kingdom .
808881 2/1959 United Kingdom .
1 540 343 2/1979 United Kingdom .

*Primary Examiner*—James R. Bidwell
*Attorney, Agent, or Firm*—Larson & Taylor

[57] ABSTRACT

The levers (8, 9) supporting the lifting member (4) and the counter-lifting member (5) are associated with respective quadrilaterals (8, 12, 18, 122 and 9, 13, 19, 122) that are articulated on horizontal spindles (10, 16, 14, 20 and 11, 17, 15, 21) which are mutually parallel and orthogonal to the tangent of the peripheral portion of the disc (1) on which the lifting means operate cyclically. One side of each articulated quadrilateral is supported laterally by a box (22) which is fixed to the base of the wrapping machine, into which box passes one of the fixed spindles (14, 15) of each quadrilateral, in order to receive, via levers and cams (23, 24, 27, 28), the necessary oscillatory motion from a shaft (29) that rotates continuously and in step with the other members of the wrapping machine. The end of the driven orientation lever (18) of the lifting member may be attached to a crank (44) which, via levers and cams (42, 40), receives its motion from the shaft (29) and enables the lifting member to be lifted and lowered following annular trajectories (47, 48) and with inclinations such as to limit and completely dispense with the cyclic stoppages of the product-feed disc (1).

13 Claims, 3 Drawing Sheets

LEVER DEVICE FOR ACTUATING THE LIFTING MEMBER AND THE COUNTER-LIFTING MEMBER IN AUTOMATIC MACHINES FOR WRAPPING SWEETS, CHOCOLATES OR SIMILAR PRODUCTS

DESCRIPTION

The invention refers to automatic machines for wrapping sweets, chocolates or similar products, equipped with a feed apparatus with at least one horizontal or substantially horizontal disc which rotates about its axis and which has evenly-spaced cavities around its periphery, located around an ideal circumference having its centre on the said axis of the disc and having a shape and size such that a single product can enter each cavity. These feed apparatuses are usually provided with a lifting member which moves upwards at the appropriate stage, passing through the said cavities one at a time and which, together with an upper counter-lifting member, grips and lifts the product and transfers it at the appropriate stage to a superjacent wrapper closing station. The wrapping material is automatically deposited on the product before the latter is gripped between the lifting member and the counter-lifting member and is held thereon by the counter-lifting member. As the product is lifted, the wrapping material interacts with means which fold it downwards and the material and product together are then inserted between superjacent means which grip them by the sides and take the place of the lifting member and the counter-lifting member which return to their initial position in order to repeat a new cycle, while the wrapping material, which is partly wrapped around the lifted product, is then in the best position to be formed into a tube and then be finally closed around the product.

In machines of this type, currently produced by the Applicant Company, and as described for example in Italian Patents no. 1,103,844 and no. 1,180,446 in the name of the said Applicant and to which the broadest reference is made, the lifting member and the counter-lifting member are usually attached to respective vertical slides which run between corresponding straight and vertical guides.

In order to ensure that the downward motion of the lifting member takes place at the same time as the rotation of the disc carrying the product, the guide of this component is in turn associated with a translation slide which runs on straight, horizontal guides. This solution entails problems in terms of the constructional complexity of the mechanism which actuates the lifting member and especially problems in terms of the wear exerted on the vertical slide and guide units, between which powdered sugar from the product being wrapped may become lodged.

In order partly to overcome these drawbacks, a known solution is, for example, that described in British patent no. 1,540,343 in the name of NAGEMA, in which the lifting member and the counter-lifting member are mounted by means of levers on a pair of coaxial actuating shafts located in the region of transfer of the product from the plate, parallel to the tangent of this transfer region. The two shafts are connected to levers which are controlled by cams which determine the necessary axial and angular displacement of the said shafts. Owing to the oscillatory motion of the lifting member and the counter-lifting member, this solution allows these components to be displaced in an approximately straight line as long as the oscillating levers which support these components are relatively long and as long as the displacements themselves are small. The considerable length of the levers limits control of the vibrations to which the lifting member and the counter-lifting member are subject in their reciprocating movement, so that the NGEMA solution does not allow high working speeds.

It is the aim of the invention to overcome these and other drawbacks by employing devices which use articulated quadrilaterals for their movement, these systems differing from known articulated parallelogram systems employed for the lifting member in some machines for wrapping products in stretch film, for example of the type described in EPA no. 90200346.6, in that they have a special construction and mutual arrangement of the levers of the articulated quadrilateral, and also in that the length and the orientation of the fixed lever of the said quadrilateral can be modified, by attaching one end of this lever to a crank which is made to oscillate at the appropriate stage as the lifting member and counter-lifting member are lifted and lowered. By adding just a few components, the device according to the invention can be converted from the solution in which the lifting member follows a substantially straight and vertical trajectory, to a solution in which the lifting member is displaced over annular trajectories, so as to limit or completely dispense with the cyclic stoppages of the product-feed disc.

Further features of the invention and the advantages which derive therefrom will become clear from the following description of a preferred embodiment of the invention, illustrated purely by way of nonlimiting example in the three appended plates of drawings, in which.

Figure 5:
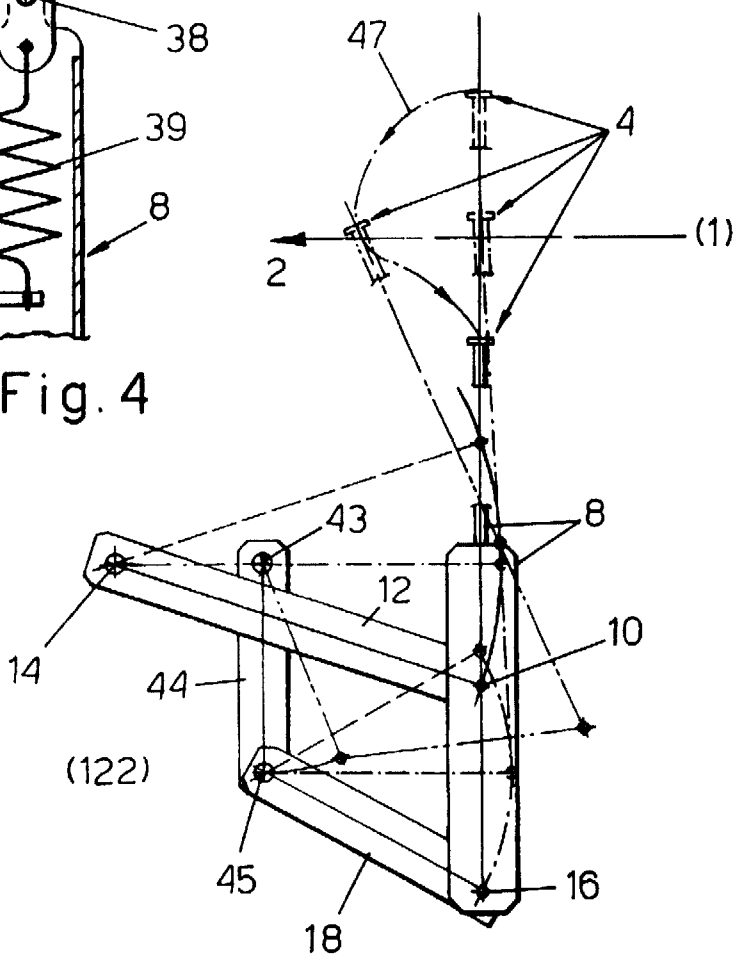
Figure 4:
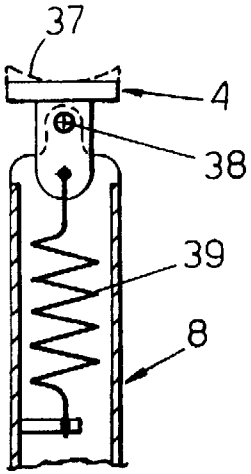
Figure 6:
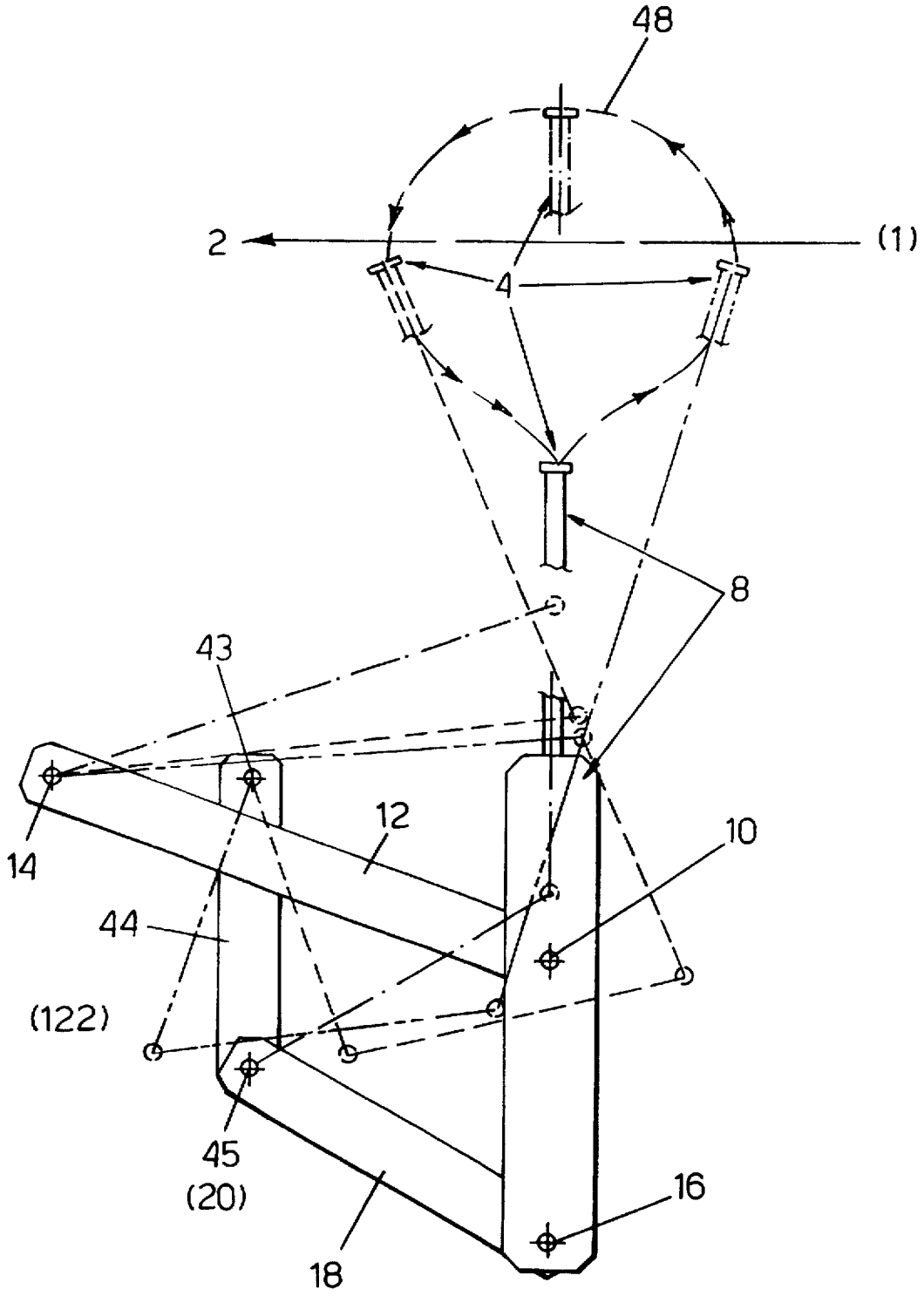

FIG. 4 diagrammatically illustrates, with some parts in cross section, a possible jointed embodiment of the head of the lifting member;

FIGS. 5 and 6 are diagrammatic side views of the lifting member in various operating positions and in the embodiment with five articulated levers, showing various displacement trajectories of the said lifting member, which allow an equivalent number of different freedoms of rotation for the disc carrying the product.

Figure 1:
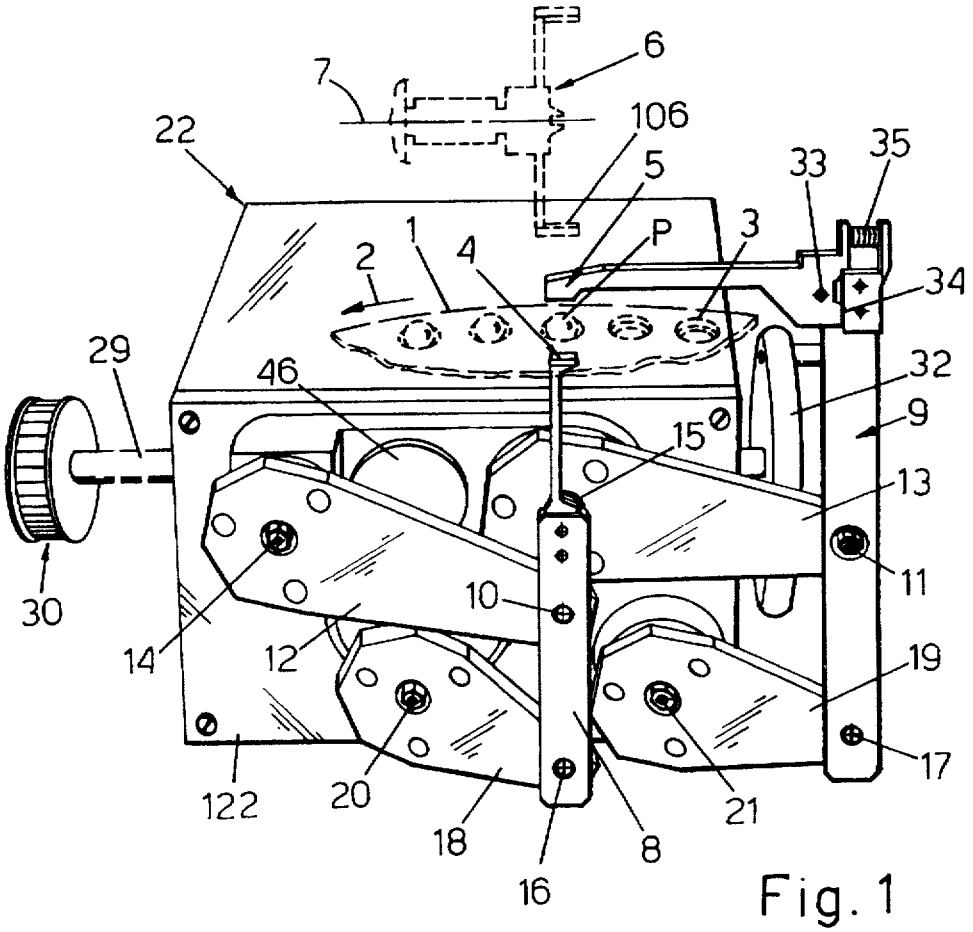
FIG. 1 is a perspective view of the device with articulated quadrilaterals which, according to the invention, actuates the lifting member and the counter-lifting member.

In FIG. 1, 1 denotes a portion of the disc of known type which rotates about a vertical axis in the direction indicated for example by the arrow 2 and has evenly-spaced through cavities 3 around its periphery, each cavity accommodating a product P that is held in the said cavities by a known lower guide which is not illustrated. As the disc 1 rotates, the cavities containing the products P cyclically come into alignment with means that place at least one piece of the wrapping material (not shown) on the product, and the lifting member 4 and the counter-lifting member 5, which are located respectively below and above the said disc, grip the product P at the appropriate stage together with the wrapping material on top of it and lift it by the amount needed to transfer it to the gripping member 106 which has been brought into position beneath a head 6 having several gripping members spaced at regular angular intervals, this head rotating step-wise about a horizontal axis 7. The said lower gripping member 106 grasps the lifted product together with the wrapping material, the lifting member is lowered to the start-of-cycle position and the counter-lifting member is lifted by an additional amount. First means, which are not shown, then come into play to fold the wrapping material around the product, after which the head 6 rotates about its axis through one step so that another, open, gripping member 106 is brought into position beneath it, the counter-lifting member being lowered and returned to its start-of-cycle position at the appropriate stage.

It may be seen from FIG. 1 that the lifting member 4 and the counter-lifting member 5 are mounted on respective vertical or substantially vertical levers 8, 9, each of which is articulated, via an intermediate point and by means of respective cylindrical articulations 10, 11, on the ends of respective identical drive levers 12, 13, the other ends of which drive levers are fixed perpendicularly to respective horizontal spindles 14, 15, the latter being mutually parallel and orthogonal to the tangent of that area of the disc 1 that interacts with the lifting member and the counter-lifting member in order to perform the cyclical transfer of a product to a gripping member of the head 6.

The lower ends of the levers 8, 9 are connected by means of cylindrical articulations 16, 17 to driven orientation levers 18, 19 which are shorter than the upper levers 12, 13 and pivot on spindles 20, 21 that are parallel to the said spindles 14, 15.

Figure 2:
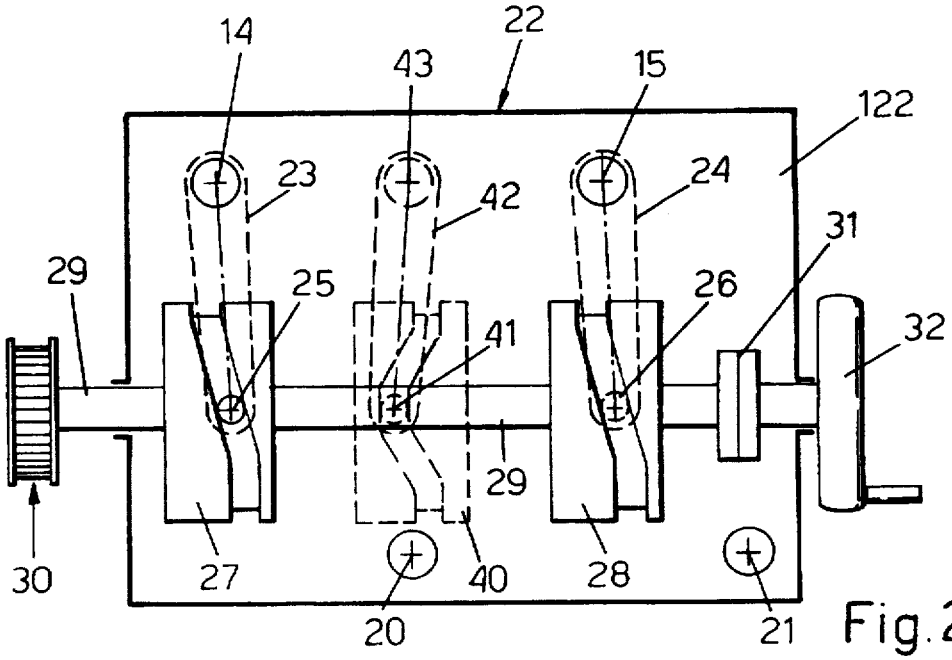
FIG. 2 is a diagrammatic side view of the internal unit comprising the cams which cause the oscillation of the drive levers and optionally of the driven orientation levers of the lifting member and of the counter-lifting member.

FIGS. 1 and 2 show that the spindles 20, 21 are supported by the side wall 122 of a parallelepiped-shaped box 22 that also rotatably supports the intermediate part of the spindles 14, 15. The external ends of these spindles 14, 15 are coupled to the levers 12, 13 while their ends inside the box 22 are coupled to the displacement levers 23, 24, the pins 25, 26 of the latter following the profiles of double-acting cams 27, 28 coupled to the shaft 29 which is rotatably supported by the said box 22 and which emerges out of the rear wall of the box in order to connect up with the other operating members of the wrapping machine by means of a drive system 30 consisting of a belt and toothed pulleys, or of another type. The other end of the shaft 29 may be connected, via a coupling 31 of known type, to a handwheel 32 by means of which the shaft can be rotated manually.

FIG. 1 shows that the counter-lifting member 5 is articulated transversely at 33 to the support lever 9 and is held at right angles thereto by means of an antagonistic spring 35 which causes that portion of the counter-lifting member 5 lying below the fulcrum 33 to bear against an abutment surface 34 on the said lever 9, and also allows the said counter-lifting member a certain degree of upward oscillation.

Purely by way of nonlimiting example, the drive levers 12, 13 have been made with a working length (the distance between the cylindrical articulations on the ends) of approximately 160 mm, the driven lever 18 having a working length of approximately 95 mm and the driven lever 19 having a working length of approximately 106 mm. The distance between the spindles 20, 21 and the horizontal line passing through the spindles 14, 15 is approximately 100 mm. The distance between the spindle 20 and the vertical line passing through the spindle 14 is approximately 66 mm, whereas the distance between the spindle 21 and the vertical line passing through the spindle 15 is approximately 51 mm. In the device produced by the Applicant Company the lifting member travels, for example, approximately 75 mm, while the counter-lifting member travels approximately 60 mm. Needless to say, the abovementioned dimensions are purely illustrative of one possible practical embodiment of the device according to the invention, and are in no way limiting, so that they may be extensively modified, depending on the specific operational requirements of the said device.

Figure 3:
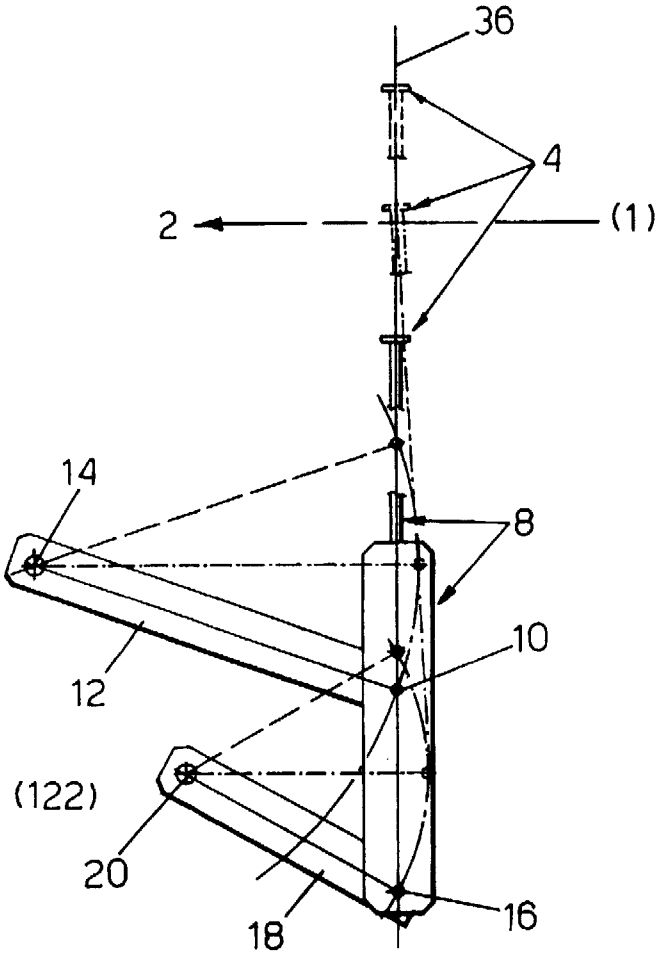
FIG. 3 is a diagrammatic side view of the lifting member in various operating positions of the embodiment with four articulated levers, according to which the upward trajectory is substantially straight, vertical and similar to the downward trajectory.

In FIG. 3 the lifting member 4 is indicated in the lower resting position by means of a solid line, in the maximum lifting position by means of a dashed line, and in the intermediate position, with the levers 12 and 18 in a horizontal position equidistant from the top end-of-travel and bottom end-of-travel positions respectively, by means of a dot-and-dash line. FIG. 3 clearly shows how the levers 12 and 18 are dimensioned and arranged such that the head of the lifting member 4 follows a substantially straight and vertical trajectory 36, even if the longitudinal axis of the support lever 8 oscillates slightly with respect to the vertical and the lifting member 4 pitches slightly. In order to prevent this slight pitching from adversely affecting the lifting of the product, the top of the lifting member may have a concave shape, as indicated by 37 in FIG. 4. As an alternative to this solution, or in combination with it, the lifting member 4 may be connected to the support lever 8 in such a way that it can oscillate on a spindle 38 parallel to the articulation 10, while an elastic means 39 normally holds the said lifting member in alignment with its support lever. Using this solution the head of the lifting member always remains horizontal.

The movement pattern of the counter-lifting member is dependent upon that of the lifting member only in the initial part of the lifting phase and it will not therefore be described here since it will be readily deduced and produced by those skilled in the art. The counter-lifting member passes through end-of-lifting and lowering phases which are known and are specific to it, since it must be lifted by an additional amount in order to disengage it from the product picked up by the lower gripping member 106 of the head 6; it is then kept temporarily lifted to allow the head to rotate through one step, and then returns on its downward travel so that it can hold the next product to be lifted by the lifting member, and be lifted in step with the latter.

The lifting member that is actuated using the solution described in FIGS. 1 and 3 assumes that the product-feed disc 1 stops cyclically. Variant embodiments of the lifting member will now be described which allow the cyclic stoppages of the disc 1 to be cut down or dispensed with altogether, thereby improving the productivity of the product wrapping machine. FIG. 2 shows that a third cam 40 can be coupled to the same shaft 29, this cam 40 being located between the cams 27, 28 and its double-acting profile controlling the pin 41 of a displacement lever 42 coupled to the spindle 43 which is rotatably supported on the wall of the box 22. This spindle 43 is located on the same ideal horizontal plane that carries the spindles 14, 15 and is for example approximately 65 mm away from the spindle 14. The end of the spindle 43 which lies outside the box is coupled to a downward-pointing crank 44, shown in FIG. 5, which in the device produced by the Applicant Company is for example approximately 100 mm long and, when the lifting member is in the bottom position, is vertical and parallel to the support lever 8 of the said lifting member. The lower spindle 45 of the crank 44 is articulated to the lever 18 instead of the spindle 20, which has been dispensed with in this example.

The wall 122 of the box 22 is provided with an opening through which the spindle 43 can be placed and, when this spindle is mounted, the lid 46 that closes off the said opening is removed and placed over the opening through which the spindle 20, now removed, previously passed. The cam 40 that actuates the crank 44 may be such that it holds the latter stationary during the lifting action of the lifting member, which therefore follows the same substantially vertical and straight trajectory 36 already discussed in relation to FIG. 3. During the lowering phase of the lifting member the cam 40 causes the crank 44 to move anticlockwise (when viewing FIG. 5) and then returns this component to its rest position. The result of this is that the downward trajectory 47 of the lifting member is curved and includes a component of horizontal displacement which, in the initial section, is in the same direction as the rotation of the disc 1 which is then able to reaccelerate and once again pick up normal working speed immediately after the upward phase of the lifting member. It is evident that the particular leftward tilt assumed by the support lever 8 of the lifting member ensures that, during the downward travel, certain parts of this lever are progressively ahead, thus facilitating this downward travel as the disc 1 moves towards the left. Once the head of the lifting member 4 has come out of the slot 3 in the disc 1, the trajectory 47 is such as to return the said lifting member progressively to the bottom and vertical position at the start of the cycle.

By giving the cam 40 an appropriate shape, the lifting member can be made to follow the annular trajectory 48 indicated diagrammatically in FIG. 6. During the upward movement, or immediately prior to the upward movement of the lifting member, the crank 44 firstly moves in a clockwise direction (when viewing FIG. 6), tilting the lever 8 of the said lifting member towards the right, in a direction opposite to the direction of displacement 2 of the disc 1. In this way the lever 8 has the best tilt for ensuring that, during the subsequent lifting movement, certain portions of this lever are, in its interaction with the cavity 3 of the disc 1, progressively ahead, thus facilitating the upward travel of the lifting member with the disc 1 moving towards the left. After its clockwise oscillation, the crank 44 returns to the vertical position and the lifting member is lifted and simultaneously displaced in the same direction of displacement as the disc 1, until it reaches the vertical position of maximum upward travel. The downward travel of the lifting member 4 takes place as already described with reference to FIG. 5, with the crank 44 oscillating firstly in an anticlockwise direction and then returning to the vertical position. In contrast to current movement systems, if the lifting member follows the movements shown in FIG. 6, no cyclic stoppages of the disc 1 are required, and the productivity of the wrapping machine is improved.

It goes without saying that the description refers to a preferred embodiment of the invention which may undergo numerous variations and modifications, especially in terms of construction, without thereby departing from the guiding principle of the invention, as set out above, as illustrated and as claimed below. In the following claims, the references given in brackets are purely used to exemplify the invention and do not limit the scope of protection afforded by these claims.

I claim:

1. Lever device for actuating a lifting member (4) and a counter-lifting member (5) in automatic machines for wrapping sweets, chocolates or other products involving similar requirements, where the automatic machine is of the type having at least one disc (1) which rotates about its vertical axis and which has evenly-spaced cavities (3) around its periphery, each cavity accommodating a product (P) which, at the appropriate stage, must be lifted by the said lifting member and simultaneously held by the said counter-lifting member so that it can be transferred to superjacent pick-up and processing means (6), characterized in that the lifting member and the counter-lifting member (4, 5) are mounted on the top of respective vertical or substantially vertical levers (8, 9) associated with respective quadrilaterals (8, 12, 18, 122 and 9, 13, 19 and 122) that are articulated on horizontal spindles (10, 16, 14, 20 and 11, 17, 15, 21) which are mutually parallel and orthogonal to the tangent of the peripheral portion of the disc on which the said lifting members (4, 5) operate cyclically, one side of each of the said articulated quadrilaterals being supported laterally by a box (22) which is fixed to the base of the wrapping machine and into which passes a fixed one of the horizontal spindles (14, 15) of each of the said quadrilaterals, in order to receive, via suitable means, the necessary oscillatory motion from a shaft (29) that rotates continuously and in step with the other members of the said wrapping machine.

2. Device according to claim 1, characterized in that the fixed spindles (14, 15) of each articulated quadrilateral, which pass into the supporting box (22) in order to receive the necessary oscillatory motion from the shaft (29) that rotates in step with all the members of the wrapping machine are orthogonal to said shaft onto which are keyed cams (27, 28), a double-acting profile of which interacts with the pins (25, 26) of displacement levers (23, 24) coupled to the said fixed spindles (14, 15).

3. Device according to claim 2, in which the levers (8, 9) supporting the lifting member and the counter-lifting member are articulated, via an intermediate point (10, 11), on the ends of respective drive levers (12, 13), the other ends of which drive levers are coupled to the articulation spindles (14, 15) which are supported laterally by the supporting box (22) and connected to the displacement levers (23, 24) which receive the necessary oscillatory motion from the said cams (27, 28), the levers of the lifting member and counter-lifting member being articulated via their lower ends to driven orientation levers (18, 19), which are located beneath the said drive levers and are shorter than the latter, the other end of these driven orientation levers being articulated to spindles (20, 21) supported laterally by the box (22) that supports the articulated quadrilaterals in question.

4. Device according to claim 3, in which the drive levers (12, 13) are the same length and are coupled to drive spindles (14, 15) located on the same horizontal plane, whereas the driven orientation levers (18, 19) are of different length and their fixed articulation spindles (20, 21) are located on different horizontal planes, the orientation lever (18) of the lifting member being shorter than the orientation lever (19) of the counter-lifting member and the fixed articulation spindle of the former being located on a higher plane than that of the fixed articulation spindle of the other orientation lever.

5. Device according to claim 2, in which the cams (27, 28) that actuate the two articulated quadrilaterals associated with the lifting member and the counter-lifting member, are so structured that the movable spindles of these quadrilaterals move through trajectories which follow an arc of a circle and vertical chords, the various levers of the said quadrilaterals having dimensions and being arranged such that the lifting member and the counter-lifting member move through substantially vertical trajectories (36).

6. Device according to the claim 3, in which the drive levers (12, 13) of the lifting member and the counter-lifting member are, for example, approximately 160 mm long, while the driven orientation levers (18, 19) of the lifting member and the counter-lifting member are approximately 95 mm and approximately 106 mm long, respectively, the horizontal and vertical misalignment between the fixed spindles (14, 20) of the lifting member drive lever and orientation lever being approximately 67 mm and 100 mm, respectively, while the corresponding misalignment between the corresponding levers (13, 19) of the counter-lifting member is approximately 50 mm and 120 mm, respectively, the vertical movement of the lifting member being approximately 75 mm.

7. Device according to claim 3, characterized in that the driven orientation lever (18) of the lifting member is articulated, via its opposite end to that (16) articulated to the lever supporting the lifting member, to the end (45) of a crank (44) which is rotatably mounted laterally on the box (22) supporting the articulated quadrilaterals which actuate the lifting member and the counter-lifting member, and which, via its own spindle (43) and by means of a lever (42) inside this box, receives the necessary oscillatory motion from a double-acting cam (40) coupled to the said shaft (29) that carries the cams (27, 28) for the levers which displace the said articulated quadrilaterals, the whole unit being arranged such that the lifting and/or lowering trajectory of the lifting member is of annular type and such that the stoppage times of the disc (1) with the product which is cyclically lifted by the said lifting member, are reduced to a minimum or dispensed with completely.

8. Device according to claim 7, in which the fixed spindle (43) on which the crank (44) rotates lies in the same ideal horizontal plane that carries the fixed spindles (14, 15) of the levers which drive the articulated quadrilaterals, and is located between these spindles, the said crank being approximately 100 mm long.

9. Device according to claim 7, in which the cam (40) that actuates the crank (44) articulated to the orientation lever (18) of the lifting member (4), is so structured as to hold the said crank stationary and vertical during the lifting travel of the said lifting member which takes place over a substantially straight and vertical trajectory (36), whereas, during the lowering travel of the lifting member, the said crank oscillates first in such a way that it displaces the lifting member in the same direction of displacement as the periphery of the disc (1) and then such that it returns to its vertical resting position, so that the said lifting member follows a curved and convex trajectory in the direction of displacement of the disc, in order to be able to come down with the said disc moving.

10. Device according to claim 7, in which the cam (40) that actuates the crank connected to the orientation lever of the lifting member (4), is structured such that it displaces the lifting member first in a direction opposite to that of displacement of the disc (1) and then in the same direction, passing through the vertical position at the end of the lifting and lowering travels, the whole such that the lifting member follows an annular trajectory which enables it to go up and come down with the disc moving, by virtue also of the opposite, and for this purpose advantageous, inclinations assumed by the lever (8) supporting the said lifting member.

11. Device according to claim 1, in which the surface of a head-end of the lifting member (4) designed to come into contact with the product, has a suitable, upward-facing, convex shape (37), so that it effectively supports the lifted product, even during small pitching movements made by the said lifting member.

12. Device according to claim 1, in which the lifting member (4) is connected to the supporting lever (8) with the ability to oscillate on a spindle (38) parallel to the articulation spindles of the articulated quadrilateral which controls the said lifting member, elastic (39) or other suitable means being provided to ensure that, during displacement, the lifting member oscillates about the said spindle, its top always remaining in a substantially horizontal position.

13. Device according to claim 1, in which the counter-lifting member (5), actuated such that it follows the lifting member in the initial part of the lifting travel and then proceeds in an independent and known way, is attached to the corresponding support lever (9) with the ability to oscillate on a spindle (33) parallel to the articulation spindles of the articulated quadrilateral which controls the said counter-lifting member, elastic means (35) being provided to hold the counter-lifting member against an abutment surface (34) attached to the support lever (9) and enable the said counter-lifting member to oscillate slightly upwards in contact with the lifted product, so as to ensure that the latter is handled delicately.

* * * * *